US011133620B2

(12) United States Patent
Ishikawa et al.

(10) Patent No.: US 11,133,620 B2
(45) Date of Patent: Sep. 28, 2021

(54) CONNECTOR HOUSING HAVING SEALING MEMBER AND PROTECTIVE WALL

(71) Applicant: YAZAKI CORPORATION, Tokyo (JP)

(72) Inventors: Yoshinori Ishikawa, Makinohara (JP); Ryosuke Ohfuku, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/870,893

(22) Filed: May 8, 2020

(65) Prior Publication Data

US 2020/0395710 A1 Dec. 17, 2020

(30) Foreign Application Priority Data

Jun. 11, 2019 (JP) ..... JP2019-108969

(51) Int. Cl.
*H01R 13/627* (2006.01)
*H01R 13/52* (2006.01)
*H01R 13/533* (2006.01)

(52) U.S. Cl.
CPC ..... *H01R 13/5219* (2013.01); *H01R 13/5205* (2013.01); *H01R 13/533* (2013.01); *H01R 13/6272* (2013.01)

(58) Field of Classification Search
CPC ..... H01R 13/6272; H01R 13/6275; H01R 13/4223; H01R 13/4362; H01R 13/5219; H01R 13/5205; H01R 13/533
USPC ..... 439/352, 357, 358, 595, 752
See application file for complete search history.

(56) References Cited

U.S. PATENT DOCUMENTS 5,104,253 A * 4/1992 Zielinski ..... H01R 13/6272 403/329
5,308,261 A * 5/1994 Kightlinger ..... H01R 13/6272 439/352
6,146,183 A * 11/2000 Jinno ..... H01R 13/6272 439/358
6,491,538 B2 * 12/2002 Fenger ..... H01R 13/6272 439/358

(Continued)

FOREIGN PATENT DOCUMENTS

CN 111969359 A 11/2020
EP 1 001 498 A2 5/2000

(Continued)

*Primary Examiner* — Thanh Tam T Le
(74) *Attorney, Agent, or Firm* — Kenealy Vaidya LLP

(57) ABSTRACT

A female terminal includes a housing main body, a sealing member mounted to the fitting protrusion of the housing main body and sealing between the fitting protrusion and the fitted hood portion of a male housing, and a lock arm including a cantilever-shaped elastic arm portion extending from an outer peripheral surface of the housing main body to a fitting side with the male housing and having a locking portion engaged with and/or disengaged from a locking protrusion formed on the male housing. A protective wall integrally provided at a base of the elastic arm portion is formed on an outer surface of the housing main body, and is provided over the housing main body at a position in the housing main body facing a gap between the hood portion and the housing main body when the fitting protrusion of the housing main body is fitted to the hood portion.

3 Claims, 10 Drawing Sheets

(56) References Cited

U.S. PATENT DOCUMENTS

| | | | | |
|---|---|---|---|---|
| 6,616,481 | B2 * | 9/2003 | Ichio | H01R 13/4361 439/595 |
| 6,659,797 | B2 * | 12/2003 | Ichio | H01R 13/4361 439/595 |
| 7,101,213 | B2 * | 9/2006 | Toyoda | H01R 13/6272 439/358 |
| 7,114,983 | B2 * | 10/2006 | Fukatsu | H01R 13/4223 439/358 |
| 7,118,403 | B1 * | 10/2006 | Drye | H01R 13/6272 439/352 |
| 7,347,710 | B2 * | 3/2008 | Ohtaka | H01R 13/518 439/352 |
| 7,500,864 | B2 * | 3/2009 | Mase | H01R 13/6272 439/352 |
| 7,753,613 | B2 * | 7/2010 | Tsuji | H01R 13/6272 403/326 |
| 8,133,076 | B2 * | 3/2012 | Nakamura | H01R 13/516 439/595 |
| 8,231,401 | B2 * | 7/2012 | Amano | H01R 13/6272 439/357 |
| 9,583,876 | B2 * | 2/2017 | Sekino | H01R 13/62933 |
| 2002/0106937 | A1 | 8/2002 | Ichio et al. | |
| 2002/0123257 | A1 | 9/2002 | Matsuoka | |
| 2002/0123260 | A1 | 9/2002 | Ichio | |
| 2002/0127913 | A1 | 9/2002 | Ichio | |
| 2016/0156130 | A1 | 6/2016 | Sekino | |
| 2020/0373705 | A1 | 11/2020 | Ishikawa et al. | |

FOREIGN PATENT DOCUMENTS

| | | | |
|---|---|---|---|
| EP | 1 168 521 | A2 | 1/2002 |
| EP | 1 235 306 | A2 | 8/2002 |
| EP | 3 200 287 | A1 | 8/2017 |
| JP | 2002-329554 | A | 11/2002 |
| JP | 2014-139873 | A | 7/2014 |
| JP | 2016-105353 | A | 6/2016 |
| JP | 2016-115411 | A | 6/2016 |
| WO | 2014/112136 | A1 | 7/2014 |

* cited by examiner

CONNECTOR HOUSING HAVING SEALING MEMBER AND PROTECTIVE WALL

CROSS-REFERENCE TO RELATED APPLICATIONS

This application is based on and claims priority under 35 USC 119 from Japanese Patent Application No. 2019-108969 filed on Jun. 11, 2019, the contents of which are incorporated herein by reference.

TECHNICAL FIELD

The present invention relates to a housing.

BACKGROUND ART

As a connector in which housings are fitted and connected to each other, there is a connector provided with an annular sealing member made of a packing or the like that seals a fitting portion between the housings and prevents water from entering a connection portion between terminals (see, for example, Patent Literatures 1, 2).

CITATION LIST

Patent Literature

Patent Literature 1: JP-A-2016-105353
Patent Literature 2: JP-A-2016-115411

SUMMARY OF INVENTION

Meanwhile, when a vehicle is washed by a high-pressure washing machine or the like, water injected at a high pressure from the high-pressure washing machine may be sprayed onto a gap between the housings of the connector mounted on the vehicle. Then, the sealing member on an inner portion may be deteriorated due to a water pressure of the sprayed water, and a sealing performance may be reduced.

The present invention has been made in view of the above circumstances, and an object thereof is to provide a housing capable of maintaining a good sealing performance with a mating housing.

In order to achieve the above object, the housing according to the present invention is characterized by the following (1) to (3), (1) A housing including:

a housing main body including a fitting protrusion fitted to a tubular hood portion of a mating housing;

a sealing member mounted to the fitting protrusion of the housing main body and configured to seal between the fitting protrusion and the fitted hood portion of the mating housing; and a lock arm including a cantilever-shaped elastic arm portion that extends from an outer peripheral surface of the housing main body to a fitting side with the mating housing and has a locking portion configured to be engaged with and/or disengaged from a locking protrusion formed on the mating housing, wherein a protective wall integrally provided at a base of the elastic arm portion is formed on an outer surface of the housing main body, and wherein the protective wall is provided over a width direction of the housing main body at a position in the housing main body facing a gap between the hood portion and the housing main body when the fitting protrusion of the housing main body is fitted to the hood portion.

(2) The housing according to (1), wherein the elastic arm portion includes a strut portion connected to the housing main body, a bent portion bent from the strut portion toward the fitting side with the mating housing, and an extending portion extending from the bent portion toward the fitting side of the mating housing, and wherein the protective wall is formed in a range, which does not reach the bent portion, in the strut portion of the elastic arm portion.

(3) The housing according to (1), wherein a tip end of the hood portion of the mating housing abuts against the protective wall by fitting the fitting protrusion of the housing main body to the hood portion of the mating housing.

According to the housing having the above configuration (1), the protective wall is disposed at the position in the housing main body facing the gap between the housing main body and the hood portion of the mating housing. Accordingly, for example, even when high-pressure water from a high-pressure washing machine is sprayed from a rear side of the housing, the high-pressure water hits the protective wall and is not sprayed directly onto the gap. For example, even when the high-pressure water is sprayed from an obliquely rear side of the housing, the high-pressure water is suppressed from being sprayed onto the gap by the protective wall. Therefore, deterioration of the sealing member due to water pressure of the high-pressure water directly sprayed onto the sealing member can be suppressed, and a good sealing performance can be maintained by the sealing member at a fitting portion with the mating housing. In addition, since the water is not directly sprayed onto the sealing member, a sufficient sealing performance can be ensured even if the sealing member is simplified and cost is reduced.

According to the housing having the above configuration (2), the elastic arm portion including the strut portion connected to the housing main body, the bent portion bent from the strut portion toward the fitting side with the mating housing, and the extending portion extending from the bent portion toward the fitting side with the mating housing swings mainly by elastic deformation at the bent portion. As a result, the locking portion of the lock arm is engaged with and/or disengaged from the locking protrusion of the mating housing. In addition, the protective wall for suppressing the spraying of the high-pressure water onto the sealing member that seals the fitting portion is formed in the range, which does not reach the bent portion, in the strut portion of the elastic arm portion. Therefore, the sealing performance can be enhanced while minimizing an influence of the lock arm on a function of engaging with and/or disengaging from the locking portion with respect to the locking protrusion of the mating housing.

According to the housing having the above configuration (3), the fitting protrusion of the housing main body is fitted to the mating housing, so that the tip end of the hood portion of the mating housing abuts against the protective wall. Therefore, the spraying of water onto the gap between the housing main body and the hood portion can be further suppressed, and the sealing performance can be further enhanced.

According to the present invention, it is possible to provide the housing capable of maintaining the good sealing performance with the mating housing.

The present invention has been briefly described above. Further, details of the present invention will be clarified by reading a mode (hereinafter, referred to as "embodiment")

for carrying out the invention to be described below with reference to accompanying drawings.

BRIEF DESCRIPTION OF DRAWINGS

FIGS. 4A and 4B are views showing the male housing, in which FIG. 4A is a front view, and FIG. 4B is a side view.

FIGS. 6A and 6B are views showing the female housing according to the present embodiment, in which FIG. 6A is a front view, and FIG. 6B is a side view.

DESCRIPTION OF EMBODIMENTS

Specific embodiments of the present invention will be described below with reference to the drawings.

(Connector)

Figure 1:
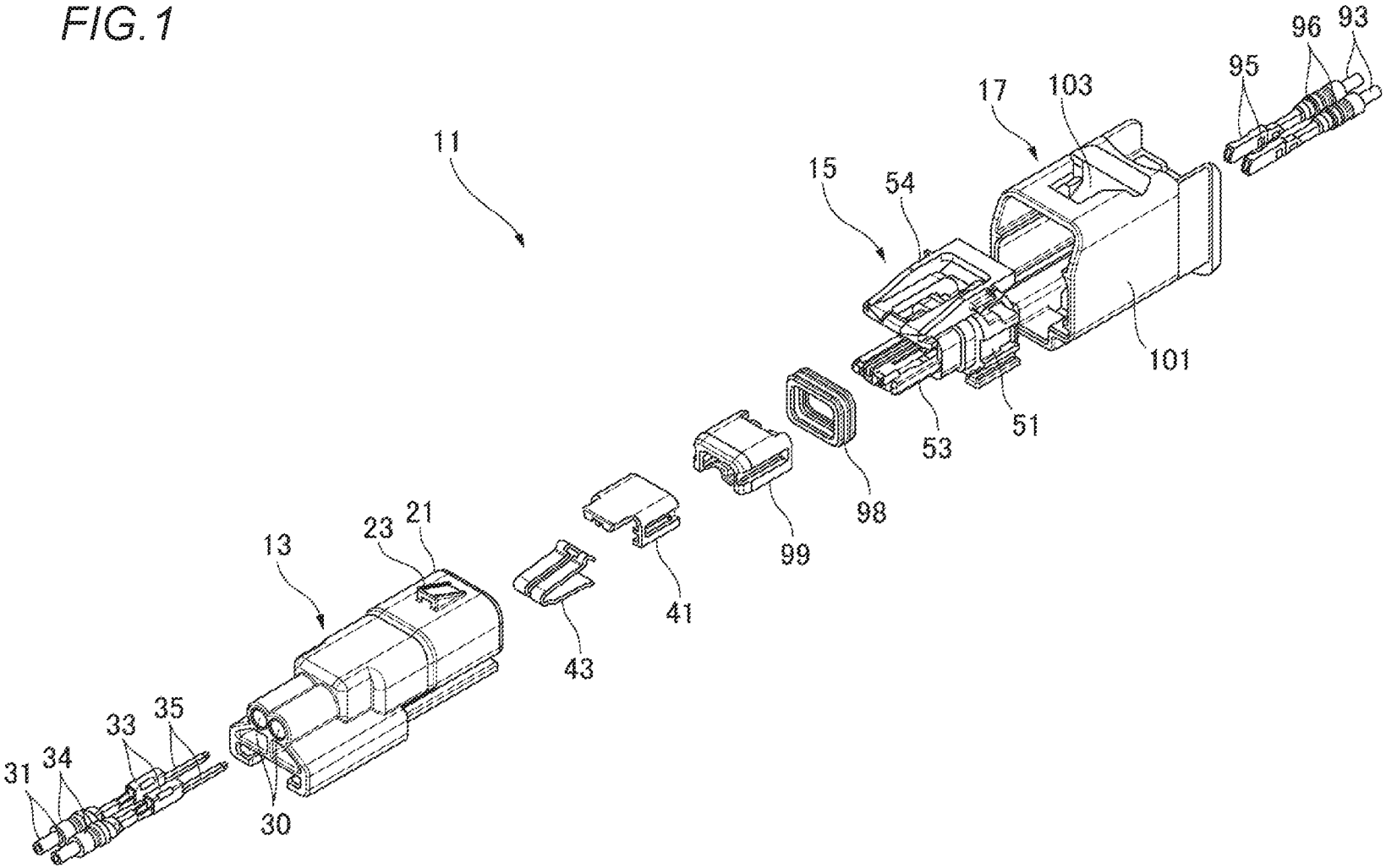
FIG. 1 is an exploded perspective view of a connector.
Figure 2:
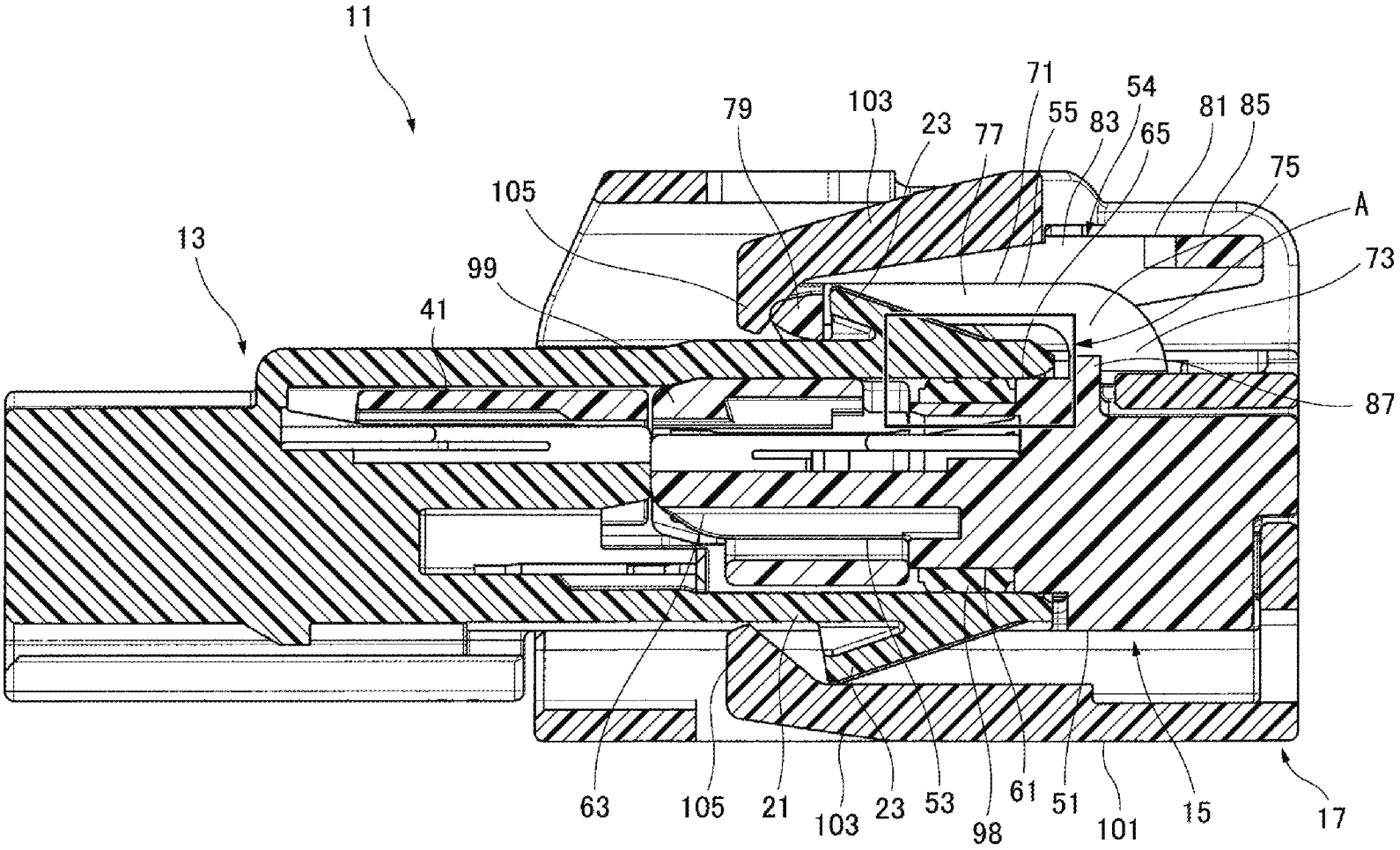
FIG. 2 is a sectional view of the connector along a fitting direction of a male housing and a female housing.

FIG. 1 is an exploded perspective view of a connector. FIG. 2 is a sectional view of the connector along a fitting direction of a male housing and a female housing.

As shown in FIGS. 1 and 2, a female housing (a housing) 15 according to the present embodiment is fitted to a male housing (a mating housing) 13, and forms a connector 11 together with the male housing 13. The connector 11 includes a tubular CPA (fitting assurance member) 17 that is slid and mounted from a rear side of the female housing 15. The male housing 13, the female housing 15, and the CPA 17 are each formed of a synthetic resin.

(Male Housing)

Figure 3:
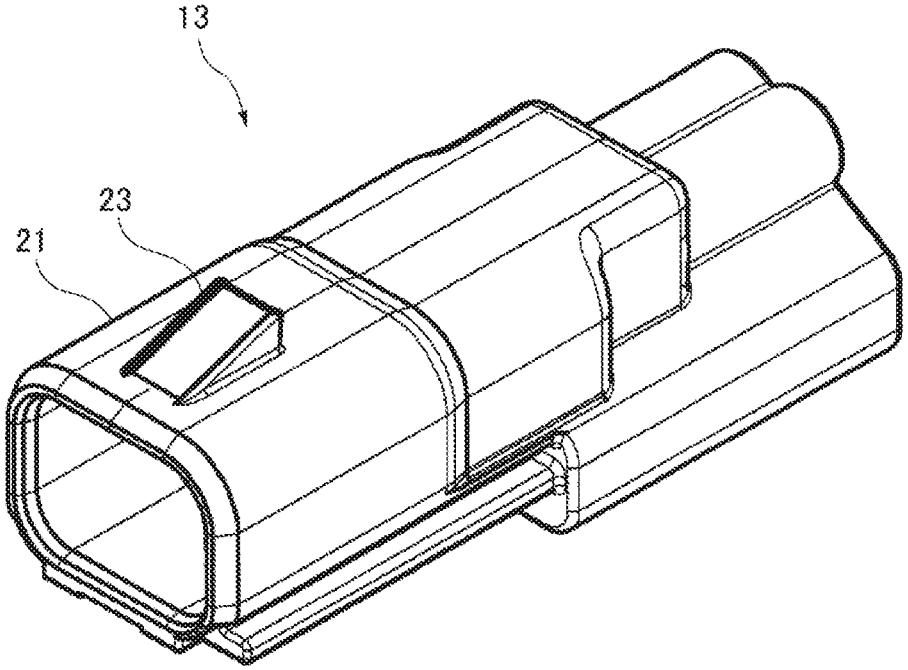
FIG. 3 is a perspective view of the male housing.
Figure 4B:
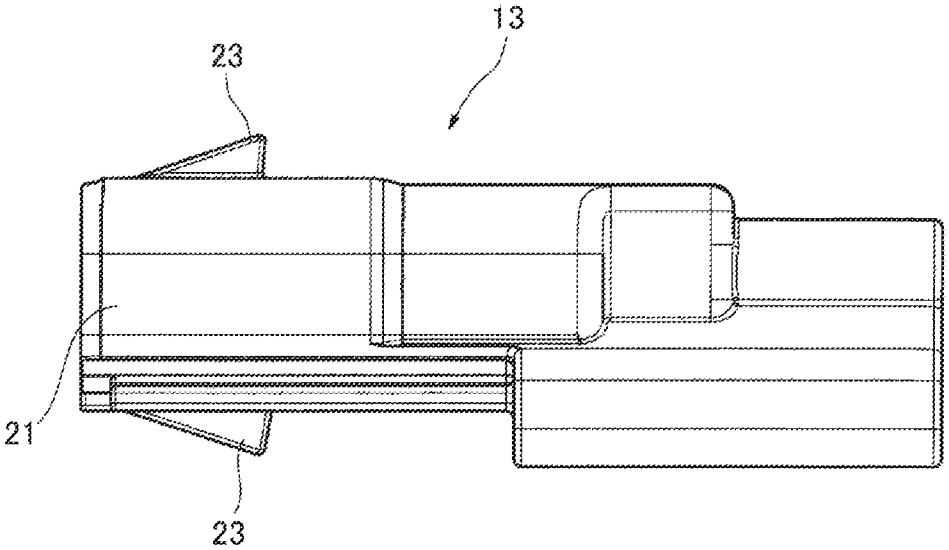
Figure 4A:
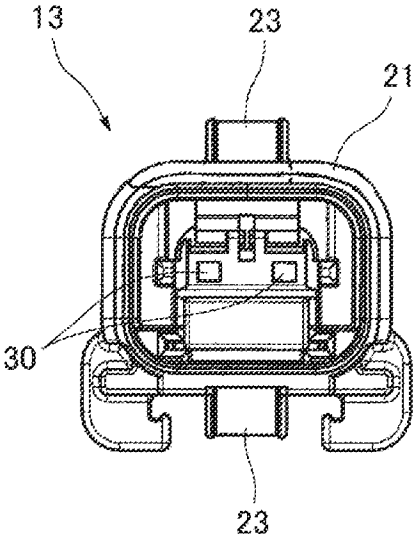

FIG. 3 is a perspective view of the male housing. FIGS. 4A and 4B are views showing the male housing, in which FIG. 4A is a front view, and FIG. 4B is a side view.

As shown in FIGS. 3, 4A and 4B, the male housing 13 according to the present embodiment includes a hood portion 21 on a tip end side that is a fitting side with the female housing 15. Locking protrusions 23 are formed on upper and lower sides of the hood portion 21.

The male housing 13 includes two terminal accommodating chambers 30 on a rear side opposite to the fitting side with respect to the female housing 15. As shown in FIG. 1, male terminals 33 connected to end portions of electric wires 31 are respectively accommodated in the terminal accommodating chambers 30, and the electric wires 31 are drawn out from a rear end of the male housing 13. Rubber plugs 34 mounted to the electric wires 31 are fitted into the terminal accommodating chambers 30 from a rear end side of the male housing 13. Accordingly, the terminal accommodating chamber 30 of the male housing 13 accommodating the male terminal 33 is waterproofed.

The male terminal 33 is formed of, for example, a conductive metal material such as copper or a copper alloy, and the electric wire 31 is crimped and connected thereto. Each of the male terminals 33 includes a tab 35 formed in a pin shape, and the tab 35 is disposed in the hood portion 21.

A front holder 41 and a short terminal 43 are assembled to the male housing 13 from a front end side. The front holder 41 is made of a synthetic resin, and by assembling the front holder 41 to the male housing 13, the male terminal 33 inserted and accommodated in the terminal accommodating chamber 30 is held in a state of being accommodated in the terminal accommodating chamber 30. The short terminal 43 is formed of, for example, a conductive metal material such as copper or a copper alloy. When the short terminal 43 is assembled to the male housing 13, the short terminal 43 comes into contact with the tab 35 of the male terminal 33 in a non-fitted state in which the female housing 15 is not fitted to the male housing 13. As a result, the male terminals 33 are electrically connected to each other at the short terminal 43, and, for example, an interlock circuit is formed.

(Female Housing)

Figure 5:
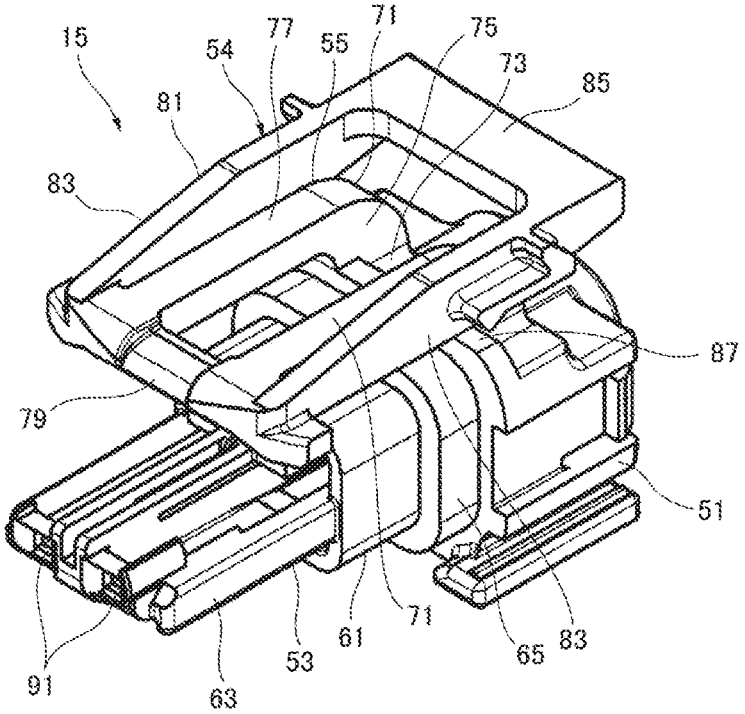
FIG. 5 is a perspective view of the female housing according to the present embodiment.
Figure 6B:
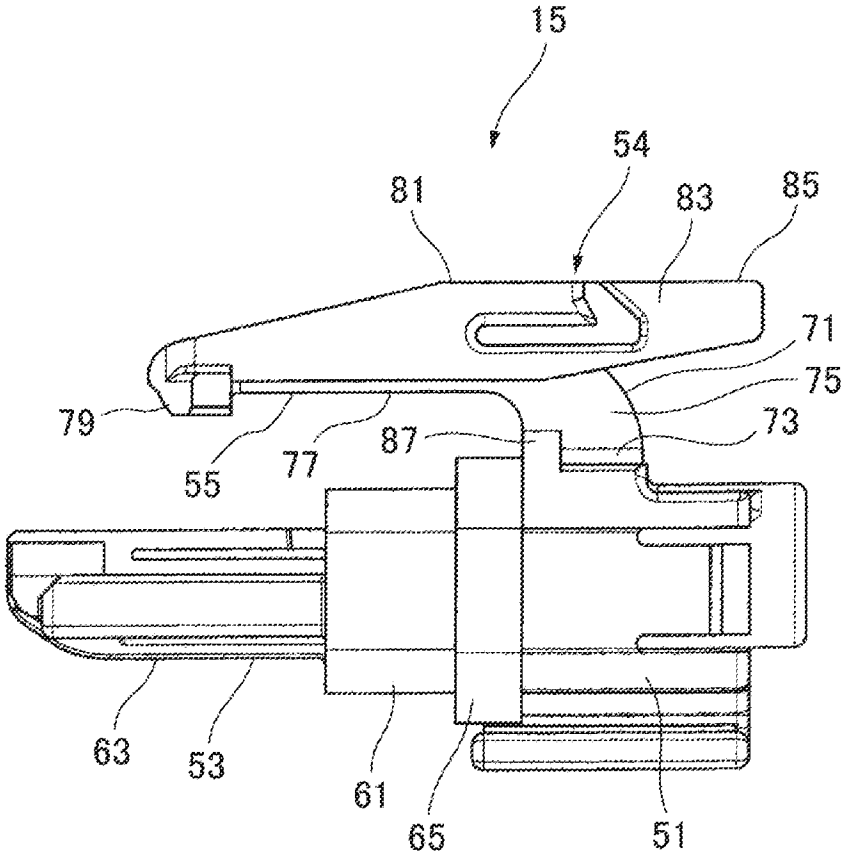
Figure 6A:
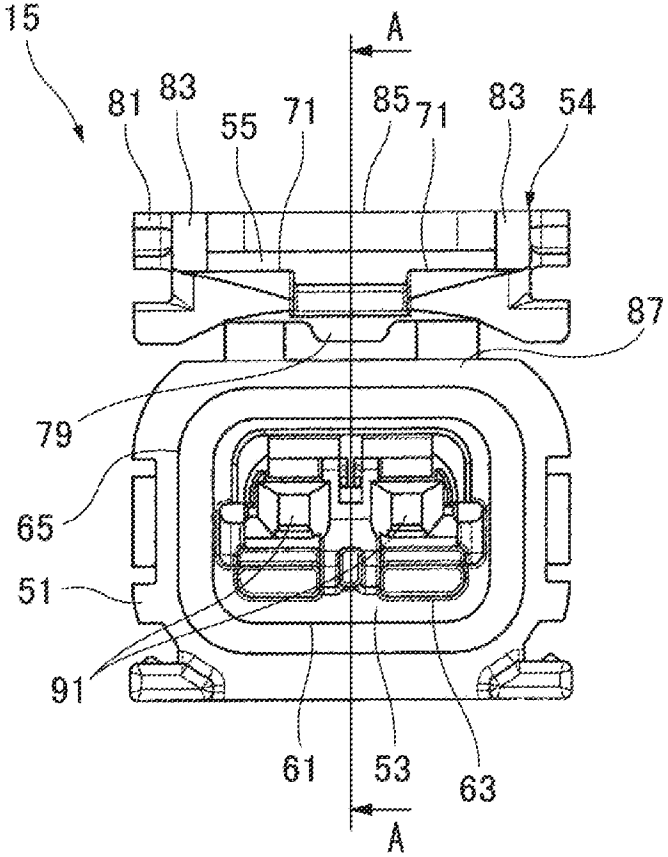
Figure 7:
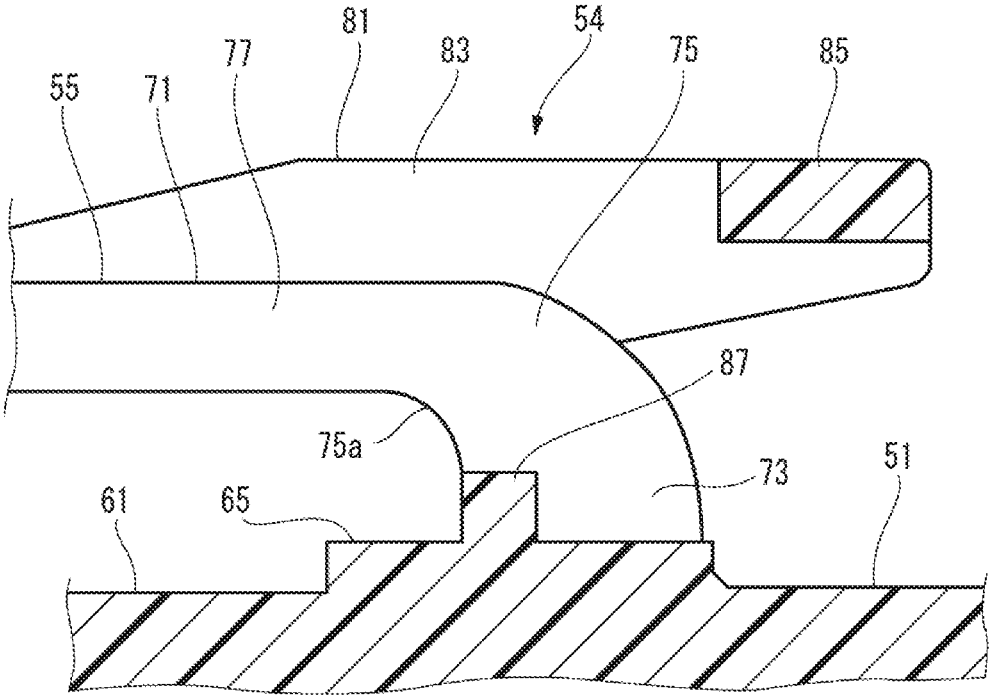
FIG. 7 is a partial sectional view taken along a line A-A in FIG. 6A.

FIG. 5 is a perspective view of the female housing according to the present embodiment. FIGS. 6A and 6B are views showing the female housing according to the present embodiment, in which FIG. 6A is a front view, and FIG. 6B is a side view. FIG. 7 is a partial sectional view taken along a line A-A in FIG. 6A.

As shown in FIGS. 5, 6A and 6B, the female housing 15 according to the present embodiment includes a housing main body 51, a fitting protrusion 53, and a locking mechanism 54. The fitting protrusion 53 protrudes forward from the housing main body 51 in the fitting direction with the male housing 13, and is fitted into the hood portion 21 of the male housing 13. The fitting protrusion 53 includes a seal mounting portion 61 and a terminal holding portion 63 in an order from the housing main body 51 side. The terminal holding portion 63 protrudes forward from the seal mounting portion 61. In the female housing 15, an edge portion of the housing main body 51 on the fitting protrusion 53 side is a fitting edge portion 65 having a larger outer shape than the seal mounting portion 61.

The locking mechanism 54 is provided on an upper portion of the housing main body 51 in the female housing 15. The locking mechanism 54 includes a lock arm 55 and a release arm 81. The lock arm 55 includes a pair of elastic arm portions 71. Each of the elastic arm portions 71 includes a strut portion 73 formed above the housing main body 51, a bent portion 75 that is bent forward from the strut portion 73, and an extending portion 77 extending forward from the bent portion 75. Tip ends of the extending portions 77 of the elastic arm portions 71 are connected to each other, and the connection portion serves as a locking portion 79. The lock arm 55 swings when the elastic arm portions 71 are elastically deformed.

The release arm 81 includes a pair of support arm portions 83 that are connected to the tip ends of the elastic arm portions 71 and extend rearward, and an operation portion 85 that connects rear ends of the support arm portions 83. Each of the support arm portion 83 extends rearward of the female housing 15 beyond the strut portion 73 of the elastic arm portion 71. Accordingly, the operation portion 85 is disposed on the more rear side of the female housing 15 than the strut portion 73 of the elastic arm portion 71.

In the locking mechanism 54, the locking portion 79 of the lock arm 55 locks the locking protrusion 23 on an upper side of the hood portion 21 of the male housing 13 when the male housing 13 and the female housing 15 are fitted to each other. As a result, the male housing 13 and the female housing 15 are locked in a state of being fitted to each other.

As shown in FIG. 7, a protective wall 87 is formed at the base of the lock arm 55 in the female housing 15. The protective wall 87 is formed at an edge portion of the housing main body 51 on the fitting side with the male housing 13, and is formed along a width direction of the housing main body 51. The protective wall 87 is formed integrally with the strut portion 73 of the lock arm 55.

The protective wall 87 is connected to the strut portion 73 of the base of the elastic arm portion 71 forming the lock arm 55, and is provided in a range that does not extend over the bent portion 75 of the elastic arm portion 71. Specifically, the protective wall 87 is formed in a range that does not extend over a circular arc portion 75*a* formed on the bent portion 75 on the fitting side with the male housing 13.

Two terminal accommodating chambers 91 are formed in the female housing 15. As shown in FIG. 1, female terminals 95 connected to end portions of electric wires 93 are respectively accommodated in the terminal accommodating chambers 91, and the electric wires 93 are drawn out from a rear end of the female housing 15. Rubber plugs 96 mounted to the electric wires 93 are fitted into the terminal accommodating chambers 91 from a rear end side of the female housing 15. Accordingly, the terminal accommodating chamber 91 of the female housing 15 accommodating the female terminal 95 is waterproofed.

A sealing member 98 and a retainer 99 are mounted to the female housing 15 from the front side. The sealing member 98 is formed in an annular shape by an elastic material such as rubber. The sealing member 98 is mounted to the seal mounting portion 61 of the fitting protrusion 53. The retainer 99 is made of a synthetic resin and is mounted to the terminal holding portion 63 of the fitting protrusion 53. The retainer 99 is mounted to the terminal holding portion 63, thereby the female terminal 95 inserted and accommodated in the terminal accommodating chamber 91 is held in a state of being accommodated in the terminal accommodating chamber 91.

(CPA)

As shown in FIGS. 1 and 2, the CPA 17 includes a main body portion 101 formed in a rectangular tubular shape, and is mounted to the female housing 15 so as to cover the female housing 15 from rear and so as to be slidable in the fitting direction. The CPA 17 includes engaging arms 103 on upper and lower sides the main body portion 101. The engaging arms 103 are supported by the main body portion 101 in a cantilever manner, and engaging claw 105 protruding inward are formed at a tip end portion thereof. When the CPA 17 is mounted to the female housing 15, the engaging claw 105 of the engaging arm 103 on the upper side abuts against a rear portion of the locking portion 79 of the lock arm 55.

(Fitting Procedure)

Next, the fitting of the male housing 13 and the female housing 15 will be described.

When the male housing 13 and the female housing 15 to which the CPA 17 is mounted are fitted, the locking portion 79 is pressed forward in the fitting direction by the engaging arm 103 on an upper side of the CPA 17.

When the locking portion 79 of the lock arm 55 gets over the locking protrusion 23 on the upper side of the hood portion 21 of the male housing 13 and locks to the locking protrusion 23, the male housing 13 and the female housing 15 are locked to each other in a fitted state. In addition, the engaging claw 105 of the engaging arm 103 on the upper side of the CPA 17 pushed forward in the fitting direction is engaged with the locking portion 79 of the lock arm 55 that locks the locking protrusion 23 on the upper side of the hood portion 21, and the engaging claw 105 of the engaging arm 103 on a lower side locks the locking protrusion 23 on the lower side of the hood portion 21. Accordingly, the CPA 17 is locked to the male housing 13 by the upper and lower engaging arms 103, and a locking state of the locking protrusion 23 by the locking portion 79 of the lock arm 55 is maintained by the engaging arm 103 on the upper side of the CPA 17 to ensure a fitting assurance state.

When the male housing 13 and the female housing 15 are fitted to each other, the fitting protrusion 53 of the female housing 15 to which the retainer 99 is mounted is inserted into the hood portion 21 of the male housing 13. As a result, the short terminal 43 is pushed down by the retainer 99 and is separated from the tab 35 of the male terminal 33, a short-circuit state of the male terminal 33 is released, and the tab 35 of the male terminal 33 is inserted into the female terminal 95 to be electrically connected to each other.

(Seal Structure)

Next, a seal structure in a state in which the male housing 13 and the female housing 15 are fitted will be described.

Figure 8:
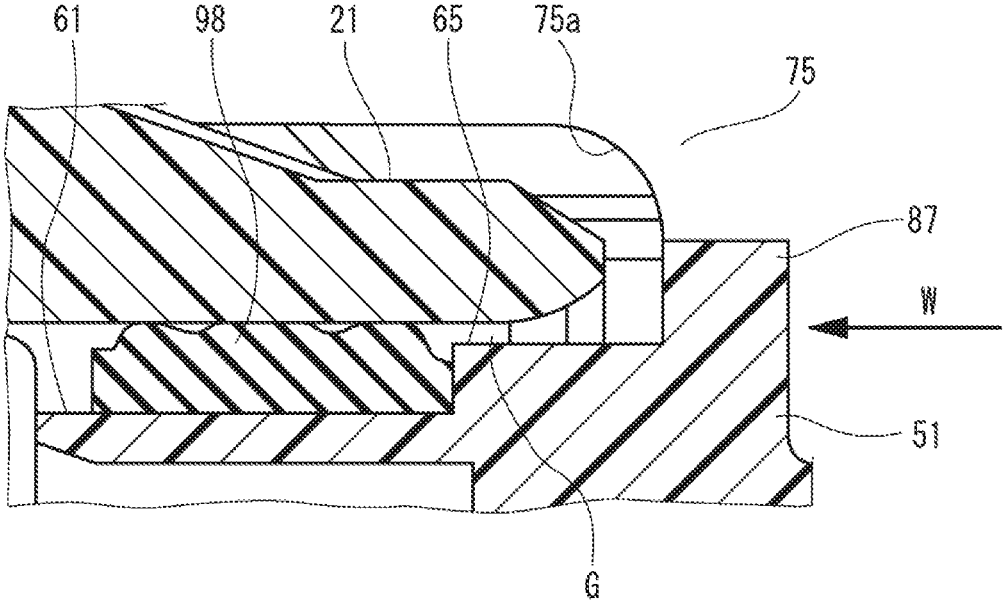
FIG. 8 is an enlarged view of a portion A in FIG. 2.

FIG. 8 is an enlarged view of a portion A in FIG. 2.

When the male housing 13 and the female housing 15 are fitted to each other, the sealing member 98 mounted to the seal mounting portion 61 of the female housing 15 comes into close contact with an inner peripheral surface of the hood portion 21 of the male housing 13. As a result, a fitting portion between the male housing 13 and the female housing 15 is sealed.

When the male housing 13 and the female housing 15 are fitted to each other, the protective wall 87 is disposed at a position facing a gap G between the inner peripheral surface of an end portion of the hood portion 21 of the male housing 13 and an outer peripheral surface of the fitting edge portion 65 of the female housing 15.

Here, a reference example will be described.

Figure 9:
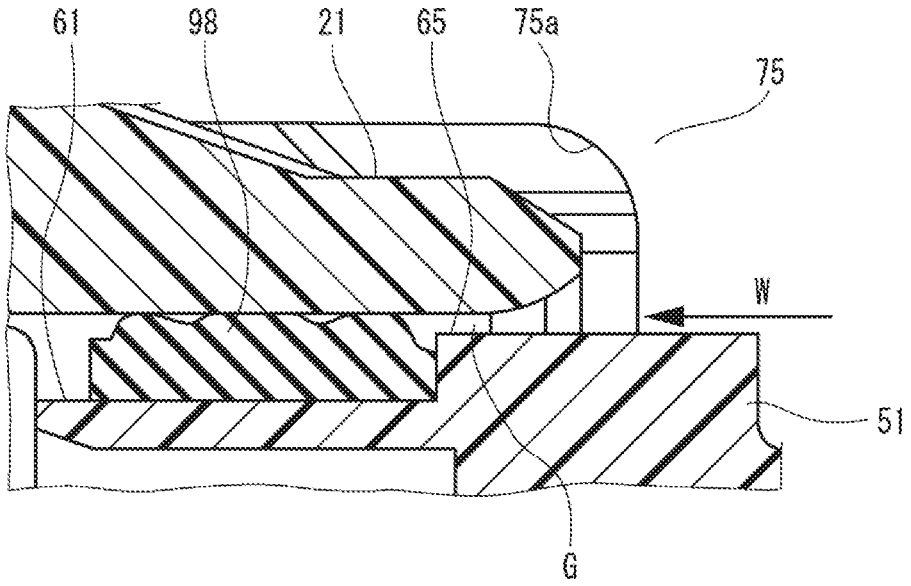
FIG. 9 is an enlarged view corresponding to the portion A of FIG. 2 according to a reference example.

FIG. 9 is an enlarged view corresponding to the portion A of FIG. 2 in the reference example.

As shown in FIG. 9, in the reference example, the gap G between the hood portion 21 and the fitting edge portion 65 of the female housing 15 is opened to the rear side of the female housing 15 in a state in which the housing main body 51 is not provided with the protective wall 87 and the male housing 13 and the female housing 15 are fitted to each other.

In this fitted state, for example, when the vehicle is washed by a high-pressure washing machine or the like, in the reference example, high-pressure water injected from the high-pressure washing machine may be sprayed from the rear side of the female housing 15 toward the gap G between the hood portion 21 and the fitting edge portion 65 of the female housing 15 (in a direction of an arrow W in FIG. 9). When the high-pressure water sprayed onto the gap G is directly sprayed onto the sealing member 98 on an inner portion through the gap G, the sealing member 98 may deteriorate due to water pressure, and a sealing performance at the fitting portion between the male housing 13 and the female housing 15 may be reduced.

In contrast, according to the present embodiment, the protective wall 87 is disposed at the position in the housing main body 51 facing the gap G between the housing main body 51 and the hood portion 21 of the male housing 13. Accordingly, for example, even when the high-pressure water from the high-pressure washing machine is sprayed toward the front side from the rear side of the female housing 15 (in a direction of an arrow W in FIG. 8), the high-pressure water hits the protective wall 87 and is not sprayed directly onto the gap G. For example, even when the high-pressure water is sprayed from an obliquely rear side of the female housing 15, the high-pressure water is suppressed from being sprayed onto the gap G by the protective wall 87. Therefore, deterioration of the sealing member 98 due to the water pressure of the high-pressure water directly sprayed onto the sealing member 98 can be suppressed, and a good sealing performance can be maintained by the sealing member 98 at the fitting portion with the male housing 13. In addition, since the water is not directly sprayed onto the sealing member 98, a sufficient sealing performance can be ensured even if the sealing member 98 is simplified and cost is reduced.

Here, the elastic arm portion 71 including the strut portion 73 connected to the housing main body 51, the bent portion 75 bent from the strut portion 73 toward the fitting side with the male housing 13, and the extending portion 77 extending from the bent portion 75 toward the fitting side with the male housing 13 swings mainly by elastic deformation at the bent portion 75. As a result, the locking portion 79 of the lock arm 55 is engaged with and/or disengaged from the locking protrusion 23 of the male housing 13.

According to the present embodiment, the protective wall 87 for suppressing the spraying of the high-pressure water onto the sealing member 98 that seals the fitting portion is formed in the range, which does not reach the bent portion 75, in the strut portion 73 of the elastic arm portion 71. Therefore, the sealing performance can be enhanced while minimizing an influence of the lock arm 55 on a function of engaging with and/or disengaging form the locking portion 79 with respect to the locking protrusion 23 of the male housing 13.

Next, a modification will be described.

The same components as those in the above embodiment are denoted by the same reference numerals, and description thereof is omitted.

Figure 10:
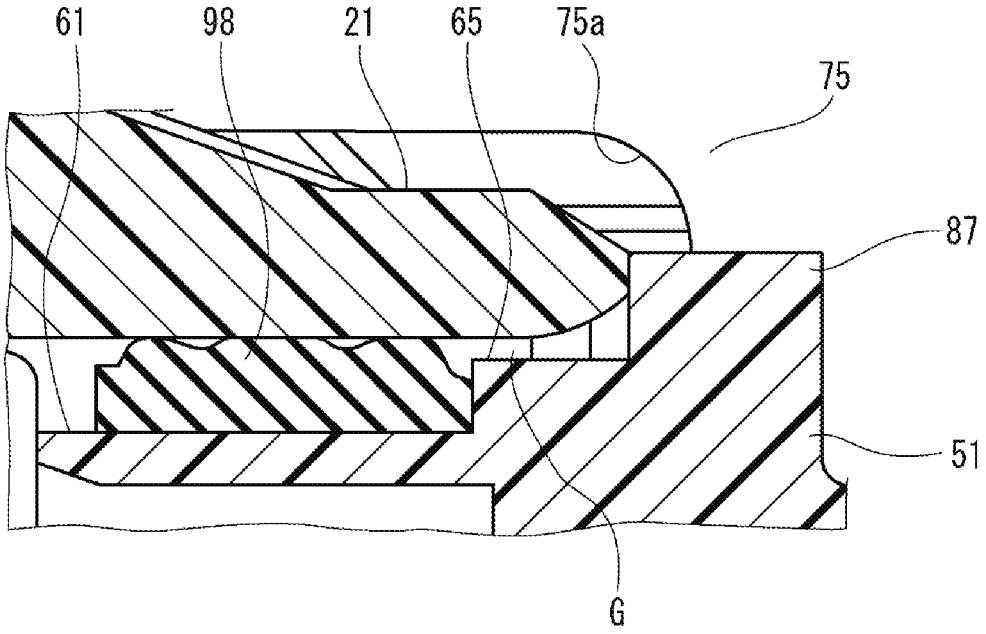
FIG. 10 is an enlarged view corresponding to the portion A of FIG. 2 according to a modification.

FIG. 10 is an enlarged view corresponding to the portion A of FIG. 2 according to the modification.

As shown in FIG. 10, in the modification, the protective wall 87 is formed so as to project forward in the fitting direction with the male housing 13.

In this modification, in the fitted state with the male housing 13, a tip end of the hood portion 21 of the male housing 13 abut against the protective wall 87 without any gap.

According to this modification, since the tip end of the hood portion 21 of the male housing 13 and the protective wall 87 abuts each other without any gap, the spraying of water onto the fitting portion between the male housing 13 and the female housing 15 can be further suppressed, and the sealing performance can be enhanced.

In the modification, the protective wall 87 projects forward in the fitting direction with the male housing 13 so that the protective wall 87 abuts against the tip end of the hood portion 21 of the male housing 13, but a forming position of the protective wall 87 may be disposed on the front side in the fitting direction with the male housing 13 so that the protective wall 87 abuts against the tip end of the hood portion 21 of the male housing 13.

The present invention is not limited to the embodiments described above, and modifications, improvements, or the like can be made as appropriate. In addition, the material, shape, size, number, arrangement position, or the like of each component in the above-described embodiments are optical and are not limited as long as the present invention can be achieved.

Here, characteristics of the housing according to the embodiments of the present invention described above will be briefly summarized in the following [1] to [3], respectively.

[1] A housing (female housing 15) including:

a housing main body (51) including a fitting protrusion (53) fitted to a tubular hood portion (21) of a mating housing (male housing 13);

a sealing member (98) mounted to the fitting protrusion (53) of the housing main body (51) and configured to seal between the fitting protrusion (53) and the fitted hood portion (21) of the mating housing (male housing 13); and a lock arm (55) including a cantilever-shaped elastic arm portion (71) that extends from an outer peripheral surface of the housing main body (51) to a fitting side with the mating housing (male housing 13) and includes a locking portion (79) configured to be engaged with and/or disengaged from a locking protrusion (23) formed on the mating housing (male housing 13), wherein a protective wall (87) integrally provided at a base of the elastic arm portion (71) is formed on an outer surface of the housing main body (51), and wherein the protective wall (87) is provided over a width direction of the housing main body (51) at a position in the housing main body (51) facing a gap ((i) between the hood portion (21) and the housing main body (51) when the fitting protrusion (53) of the housing main body (51) is fitted to the hood portion (21).

[2] The housing according to [1], wherein the elastic arm portion (71) includes a strut portion (73) connected to the housing main body (51), a bent portion (75) bent from the strut portion (73) toward the fitting side with the mating housing (male housing 13), and an extending portion (77) extending from the bent portion (75) toward the fitting side of the mating housing (male housing 13), and wherein the protective wall (87) is formed in a range, which does not reach the bent portion (75), in the strut portion (73) of the elastic arm portion (71).

[3] The housing according to [1], wherein a tip end of the hood portion (21) of the mating housing (male housing 13) abuts against the protective wall (87) by fitting the fitting protrusion (53) of the housing main body (51) to the hood portion (21) of the mating housing (male housing 13).

What is claimed is:

1. A housing comprising:

a housing main body including a fitting protrusion fitted to a tubular hood portion of a mating housing;

a sealing member mounted to the fitting protrusion of the housing main body and configured to seal between the fitting protrusion and the fitted hood portion of the mating housing; and a lock arm including a pair of cantilever-shaped elastic arm portions that extend from an outer peripheral surface of the housing main body to a fitting side with the mating housing and has a locking portion configured to be engaged with and/or disengaged from a locking protrusion formed on the mating housing, wherein a protective wall integrally provided at a base of the elastic arm portion is formed on an outer surface of the housing main body, and wherein the protective wall is provided over a width direction of the housing main body at a position in the housing main body facing a gap between the hood portion and the housing main body when the fitting protrusion of the housing main body is fitted to the hood portion, wherein the elastic arm portion includes a strut portion connected to the housing main body, a bent portion bent from the strut portion toward the fitting side with the mating housing, and an extending portion extending from the bent portion toward the fitting side of the mating housing, and wherein the protective wall is formed in a range, which does not reach the bent portion, in the strut portion of the elastic arm portion.

2. The housing according to claim 1, wherein a tip end of the hood portion of the mating housing abuts against the protective wall by fitting the fitting protrusion of the housing main body to the hood portion of the mating housing.

3. The housing according to claim 1, wherein the housing includes a fitting edge portion located between the sealing member and the protective wall, the sealing member abuts the fitting edge portion, and the fitting edge portion extends into the hood portion of the mating housing.

* * * * *